US005441857A

United States Patent [19]

Odenwälder et al.

[11] Patent Number: 5,441,857

[45] Date of Patent: Aug. 15, 1995

[54] COLOR PHOTOGRAPHIC RECORDING MATERIAL

[75] Inventors: Heinrich Odenwälder, Leverkusen; Peter Bell, Cologne; Johannes Willsau, Leverkusen, all of Germany

[73] Assignee: Agfa Gevaert AG, Leverkusen, Germany

[21] Appl. No.: 329,847

[22] Filed: Oct. 27, 1994

[30] Foreign Application Priority Data

Nov. 8, 1993 [DE] Germany ..... 43 38 104.9

[51] Int. Cl.[6] ..... G03C 7/305; G03C 7/32

[52] U.S. Cl. ..... 430/506; 430/543; 430/548

[58] Field of Search ..... 430/226, 543, 548, 506

[56] References Cited

U.S. PATENT DOCUMENTS

| | | | |
|---|---|---|---|
| 2,296,306 | 9/1942 | Peterson | 430/543 |
| 2,353,754 | 7/1944 | Peterson | 430/543 |
| 2,412,700 | 12/1946 | Weissberger et al. | 430/543 |
| 3,227,551 | 1/1966 | Barr et al. | 430/226 |
| 4,338,393 | 7/1982 | Bailey et al. | 430/548 |
| 4,438,193 | 3/1984 | Uemura et al. | 430/548 |
| 4,482,629 | 11/1984 | Nakagawa et al. | 430/548 |
| 4,526,863 | 7/1985 | Mihayashi et al. | 430/543 |
| 4,985,351 | 1/1991 | Matejject et al. | 430/598 |
| 5,158,864 | 10/1992 | Matejec et al. | 430/505 |

*Primary Examiner*—Richard L. Schilling
*Attorney, Agent, or Firm*—Connolly & Hutz

[57] ABSTRACT

Color photographic silver halide material of the negative type, in which at least one silver halide emulsion layer contains a compound of the formula $$A\text{-}B\text{-}(T_1)_m\text{-}(COUP\text{-}D)\text{-}(T_2)_n \quad (I),$$

wherein

A represents a ballast group,

B represents the radical of a compound which reacts to release $(T_1)_m$-(COUP-D)-$(T_2)_n$ during development, $T_1$ and $T_2$ represent time-regulating units which can be released during development, m, n are 0 or 1, COUP represents the radical from a 4-equivalent coupler and D represents a group with an affinity for silver, distinguished by improved sensitivity.

8 Claims, No Drawings

COLOR PHOTOGRAPHIC RECORDING MATERIAL

The invention relates to a colour photographic silver halide material of the negative type with improved sensitivity.

It is known that the sensitivity of photographic silver halide materials can be increased by using so-called DAR and FAR couplers (Development Accelerator Releasing and Fogging Agent Releasing couplers), which release either a development accelerator or fogging agent during the coupling reaction with the developer oxidation product. The increase in sensitivity, however, is not sufficient for many purposes. In addition fogging, is increased to an undesirable extent.

The object of the present invention was to provide additives for photographic materials with which an increase in sensitivity can be produced without a simultaneous increase in fogging.

Surprisingly, it is now found that such an increase in sensitivity is achieved when compounds are used which release a 4-equivalent coupler with an adhering group which has an affinity for silver. This type of compound is called an ACR compound (Adsorbing Coupler Releasing) in the following. In this case, the compound-radical releasing the 4-equivalent coupler carries a ballast group which makes the compound resistant to diffusion whereas the coupler being released has a group with an affinity for silver by means of which it is adsorbed onto silver grains.

The invention therefore provides a colour photographic silver halide material of the negative type, in which at least one silver halide emulsion layer contains a compound of the formula $$A\text{-}B\text{-}(T_1)_m\text{-}(COUP\text{-}D)\text{-}(T_2)_n \qquad (I)$$

wherein

A represents a ballast group

B represents the radical from a compound which reacts to release $(T_1)_m$-(COUP-D)-$(T_2)_n$ during development, $T_1$ and $T_2$ represent time-regulating units which can be released during development, m, n are 0 or 1

COUP represents the radical from a 4-equivalent coupler and

D represents a group with an affinity for silver.

Suitable groups D which have an affinity for silver preferably correspond to the formulas II*a* to II*e*:

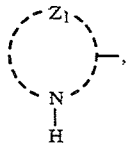

IIa

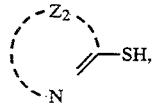

IIb

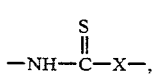

IIc

-continued

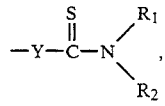

IId

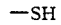

IIe in which $Z_1$ represents the remaining members for completion of a preferably 5 or 6-membered ring which contains at least one other hetero-atom such as a nitrogen or sulphur atom, $Z_2$ represents the remaining members for completion of a preferably 5 or 6-membered ring, X represents —$NH_2$, —NHR, —$N(R)_2$, —NH—$NH_2$, —NH—NHR, —SR, —OR, Y represents —S—, —NR—, —O—, R represents an aliphatic, aromatic or heterocyclic group and $R_1$, $R_2$ represent H, an aliphatic, aromatic or heterocyclic group or together represent the remaining members of a 5 or 6-membered ring.

The group with an affinity for silver can be linked to the 4-equivalent coupler directly or via an intermediate unit.

Preferred divalent intermediate members Z are alkylene groups, arylene groups, —$COCH_2$—, —$COCH_2$—S—, —$COCH_2$—O—,

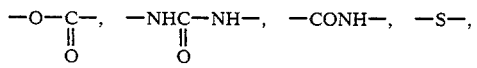

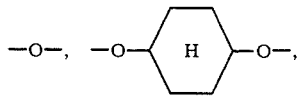

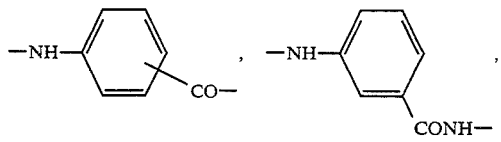

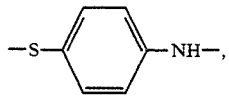

(COUP-D) can be bonded to $T_1$ via a bond from COUP or from D. The same applies to $T_2$.

The group A-B can be a coupling group, a redox compound or a group which can release the group $(T_1)_m$-(COUP-D)-$(T_2)_n$, e.g. alone or by means of the alkali in the developer independently of the image. Suitable redox compounds are oxidisable compounds which can release the group $(T_1)_m$-(COUP-D)-$(T_2)_n$ following oxidation.

Release of (COUP-D) from a compound of the formula I, in which B is a coupling group, takes place by reaction with the developer oxidation product EOP in accordance with the scheme:

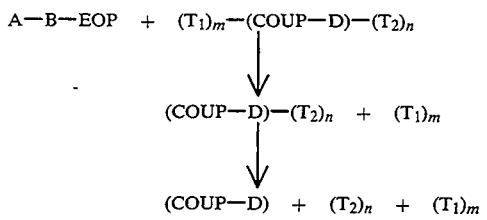

Known time-regulating units $T_1$ are described in U.S. Pat. Nos. 4,146,396, 4,248,962, 4,409,323, 4,421,845, DE 26 26 315 and U.S. Pat. No. 4,546,073. $T_1$ can also be a coupling group. $T_2$ can be a hydrolysable group such as —$OCOCH_2Cl$, —OCO—phenyl, —$OSO_2CH_3$,

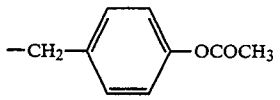

or

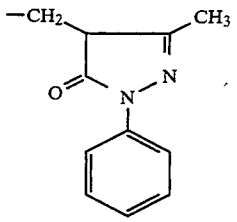

or a coupling group

The group A-B is preferably a group from a 2-equivalent coupler which contains the group $(T_1)_m$-(COUP-D)-$(T_2)_n$ bonded in a releasable manner to the coupling site. (COUP-D) is preferably linked to B via the group D which has an affinity for silver. Preferably, (COUP-D) does not contain a ballast group which makes it resistant to diffusion.

As coupling groups, B and COUP can be groups from yellow, magenta or cyan couplers or groups from couplers which do not produce a colour.

Compounds of the formula I are used in particular in amounts of 0.0005 to 0.05 mmol/$m^2$ of photographic material, wherein the total amount can be used in one layer or distributed in several layers. Preferably, compounds of the formula I are used in double or triple-layered packages in the highly sensitive layers. Instead of one compound of the formula I, mixtures of several compounds of the formula I can be used, wherein the previously stated amounts also apply in this case as the total amounts.

Examples of colour photographic materials of the negative type are colour negative films, colour photographic paper, colour reversal films and colour reversal paper. The invention is of special value for colour negative films.

Suitable supports for preparing this type of colour photographic material are e.g. films and sheeting of semi-synthetic and synthetic polymers, such as cellulose nitrate, cellulose acetate, cellulose butyrate, polystyrene, polyvinylchloride, polyethyleneterephthalate and polycarbonate and paper laminated with a baryta layer or an α-olefinic-polymer (e.g. polyethylene) layer. These supports may also be coloured with dyes and pigments, for example titanium dioxide. They may also be coloured black to screen them from light. The surface of the support is generally subjected to treatment in order to improve adhesion of the photographic emulsion layer, for example corona discharge with subsequent application of a substrate layer.

The colour photographic materials usually contain at least one red-sensitive, one green-sensitive and one blue-sensitive silver halide emulsion layer and optionally intermediate layers and protective layers.

Essential constituents of the photographic emulsion layers are binders, silver halide grains and colour couplers.

Gelatine is preferably used as binder. This can be replaced, completely or partially, however, by other synthetic, semi-synthetic or even naturally occurring polymers. Synthetic gelatine substitutes are, for example, polyvinylalcohol, poly-N-vinylpyrrolidone, polyacrylamide, polyacrylic acid and their derivatives, in particular their mixed polymers. Naturally occurring gelatine substitutes are, for example, other proteins such as albumin or casein, cellulose, sugar, starches or alginates. Semi-synthetic gelatine substitutes are generally modified natural products. Cellulose derivatives such as hydroxyalkyl cellulose, carboxymethyl cellulose and phthalyl cellulose and gelatine derivatives which have been obtained by reaction with alkylating or acylating agents or by grafting on polymerisable monomers are examples thereof.

The binder should have an adequate amount of functional groups available for sufficiently stable layers to be produced by reaction with suitable hardeners. Such functional groups are in particular amino groups, but also carboxyl groups, hydroxyl groups and active methylene groups.

The preferably used gelatines can be obtained by acid or alkaline digestion. Oxidised gelatines can also be used. The production of this type of gelatine is described, for example, in "The Science and Technology of Gelatine", edited by A. G. Ward and A. Courts, Academic Press, 1977, p. 295 et seq. The particular gelatine used should contain as small an amount as possible of photographically active impurities (inert gelatines). Gelatines with high viscosity and a low tendency to swell are particularly advantageous.

The silver halide found in the photographic material as a light sensitive constituent can contain chloride, bromide or iodide or mixtures thereof as the halide component. By way of example, the halide fraction in at least one layer can consist of 0 to 15 mol. % iodide, 0 to 100 mol. % chloride and 0 to 100 mol. % bromide. The colour photographic material according to the invention preferably contains silver bromide iodide emulsions with 5 to 15 mol. % of silver iodide.

These are mainly compact crystals which can have, e.g., regular cubic or octahedral shapes or intermediate shapes. Preferably, however, platelet crystals can also be present, these having an average diameter to thickness ratio of at least 5:1, wherein the diameter of a grain is defined as the diameter of a circle with the same area as the projected area of the grain. The layers can also, however, have tabular silver halide crystals in which the diameter to thickness ratio is essentially larger than 5:1, e.g. 12:1 to 30:1.

The silver halide grains can also have a multi-layered granular structure, in the simplest case with an internal and an external granular region (core/shell), wherein the halide composition and/or other modifications, such as e.g. doping of the individual granular regions, are different. The average granular size of the emulsions is preferably between 0.2 μm and 2.0 μm, the distribution of grain sizes can be both homodisperse and heterodisperse. Homodisperse distribution of grain size means that 95% of the grains differ from the average granular size by not more than ±30%. The emulsions can also contain organic silver salts, e.g. silver benztriazolate or silver behenate, in addition to silver halide.

Two or more types of silver halide emulsions, which are produced separately, can be used as a mixture.

The photographic emulsions can be prepared from soluble silver salts and soluble halides by various methods (e.g. P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsion, The Focal Press, London (1966)).

In addition to growing by means of precipitation, the silver halide crystals can also grow by physical ripening (Ostwald ripening), in the presence of excess halide and/or silver halide complexing agent. Growth of the emulsion grains can even take place mainly by Ostwald ripening, wherein preferably a fine-grained, so-called Lippmann emulsion, is mixed with a barely soluble emulsion and allowed to dissolve and recrystallise on the latter.

During precipitation and/or physical ripening of the silver halide grains, salts or complexes of metals such as Cd, Zn, Pb, Tl, Bi, Ir, Rh, Fe may also be present.

Furthermore, precipitation can also take place in the presence of sensitising dyes. Complexing agents and/or dyes can be rendered inactive at any time, e.g. by altering the pH or by oxidative treatment.

After completion of crystal formation or also at an earlier stage, the soluble salts are removed from the emulsion, e.g. by noodling and washing, by flocculating and washing, by ultrafiltration or by using an ion-exchanger.

The silver halide emulsion is in general subjected to chemical sensitisation under specific conditions (pH, pAg, temperature, concentration of gelatine, silver halide and sensitiser) to achieve optimum sensitivity and fogging.

The procedure is described e.g. in H. Frieser "Die Grundlagen der Photographischen Prozesse mit Silberhalogeniden" pages 675–734, Akademische Verlagsgesellschaft (1968).

Here, chemical sensitisation can take place with the addition of compounds of sulphur, selenium, tellurium and/or compounds of metals from group VIII B in the Periodic System (e.g. gold, platinum, palladium, iridium), furthermore thiocyanate compounds, surface active compounds, such as thioethers, heterocyclic nitrogen compounds (e.g. imidazoles, azaindenes) or even spectral sensitisers (described e.g. in F. Hamer "The Cyanine Dyes and Related Compounds", 1964, and Ullmanns Encyclopädie der technischen Chemie, 4th ed. vol. 18, p. 431 et seq., and Research Disclosure no. 17643, section III) can be added. Instead, or in addition, a reducing sensitisation with the addition of reducing agents (tin-II salts, amines, hydrazine derivatives, aminoboranes, silanes, formamidinesulphinic acid) can be performed by means of hydrogen, by low pAg (e.g. below 5) and/or high pH (e.g. above 8).

The photographic emulsions can contain compounds for inhibiting fog formation or for stabilising the photographic function during production, storage or photographic processing.

Particularly suitable are aza-indenes, preferably tetra and penta-azaindenes, especially those which are substituted with hydroxyl or amino groups. This type of compound has been described by e.g. Birr, Z. Wiss. Phot. 47 (1952), p. 2–58. Furthermore, salts of metals such as mercury or cadmium, aromatic sulphonic or sulphinic acids such as benzene-sulphinic acid, or nitrogen-containing heterocyclic compounds such as nitrobenzimidazole, nitroindazole, optionally substituted benztriazoles or benzthiazolium salts can be used as anti-fogging agents. Particularly suitable are heterocyclic compounds which contain mercapto groups, e.g. mercaptobenzthiazoles, mercaptobenzimidazoles, mercaptotetrazoles, mercaptothiadiazoles or mercaptopyrimidines, wherein these mercaptoazoles can also contain a group which promotes water-solubility, e.g. a carboxyl group or sulpho group. Further suitable compounds are published in Research Disclosure no. 17643 (1978), section VI.

Stabilisers can be added to the silver halide emulsions before, during or after ripening. Obviously, the compounds can also be added to other photographic layers which are assigned to a halogen silver layer.

Mixtures of two or more of the compounds mentioned may also be used.

The photographic emulsion layers or other hydrophilic colloidal layers in the light-sensitive material produced in accordance with the invention can contain surface active agents for various purposes, such as coating aids to prevent electrostatic charging, to improve sliding properties, to emulsify the dispersion, to inhibit adhesion and to improve the photographic characteristics (e.g. development: acceleration, high contrast, sensitisation etc.). In addition to natural surface active compounds, e.g. saponin, mainly synthetic surface active compounds (surfactants) are used: non-ionic surfactants, e.g. alkylene oxide compounds, glycerine compounds or glycidol compounds, cationic surfactants, e.g. higher alkylamines, quaternary ammonium salts, pyridine compounds and other heterocyclic compounds, sulphonium compounds or phosphonium compounds, anionic surfactants which contain an acid group, e.g. carboxylic acid, sulphonic acid, phosphoric acid, sulphuric ester or phosphoric ester groups, ampholytic surfactants, e.g. amino-acid and amino-sulphonic acid compounds and sulphuric or phosphoric esters of an aminoalcohol.

The photographic emulsions can be spectrally sensitised by using methine dyes or other dyes. Particularly suitable dyes are cyanine dyes, merocyanine dyes and complex merocyanine dyes.

A review of the polymethine dyes which are suitable as spectral sensitisers, their suitable combinations and supersensitising combinations is given in Research Disclosure 17643/1978, section IV.

The following dyes, arranged in order of spectral region, are particularly suitable:

1. as red sensitisers 9-ethylcarbocyanine with benzthiazol, benzselenazol or naphthothiazol as basic terminal groups, which can be substituted in the 5 and/or 6 position by halogen, methyl, methoxy, carbalkoxy or aryl groups and 9-ethyl-naphthoxathiacarbocyanine or 9-ethyl-selenacarbocyanine and 9-ethyl-naphthothiaoxacarbocyanine or 9-ethyl-benzimidazocarbocyanine, provided that the dyes carry at least one sulphoalkyl group on the heterocyclic nitrogen atom.

2. as green sensitisers 9-ethylcarbocyanine with benzoxazol, naphthoxazol or one benzoxazol and one benzthiazol as basic terminal groups, and benzimidazocarboxyanine, which can also be further substituted and also must contain at least one sulphoalkyl group on the heterocyclic nitrogen atom.
3. as blue sensitisers symmetric or asymmetric benzimidazo, oxa, thia or selenacyanines with at least one sulphoalkyl group on the heterocyclic nitrogen atom and also further substituents in the aromatic ring, and apomerocyanines with a thiocyanate group.

Sensitisers do not need to be used if the inherent sensitivity of the silver halide is sufficient for a specific spectral region, for example the blue sensitivity of silver bromides.

Suitable compounds of the formula I are

I-1

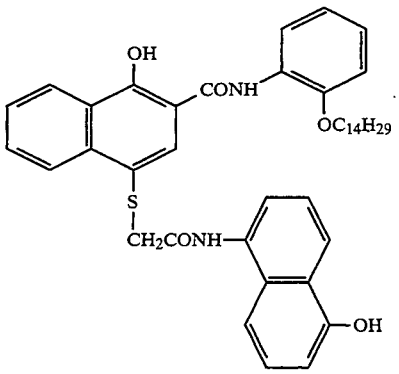

I-2

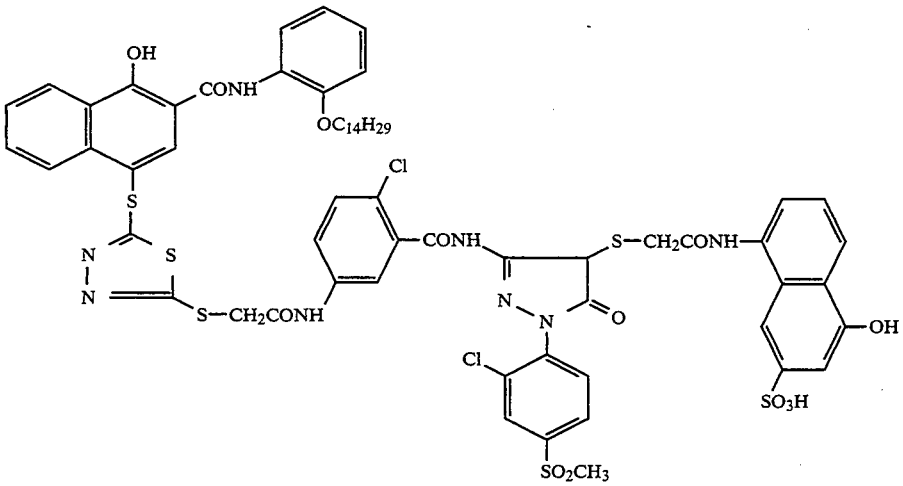

I-3

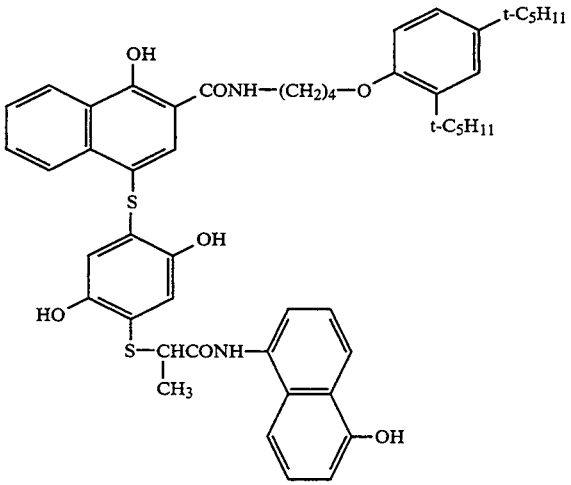

-continued
I-4
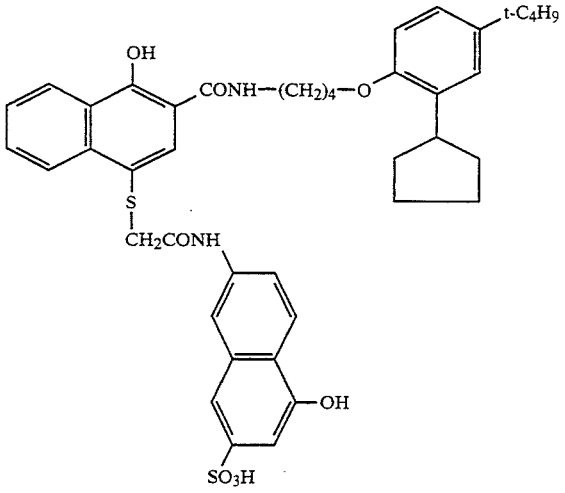
I-5
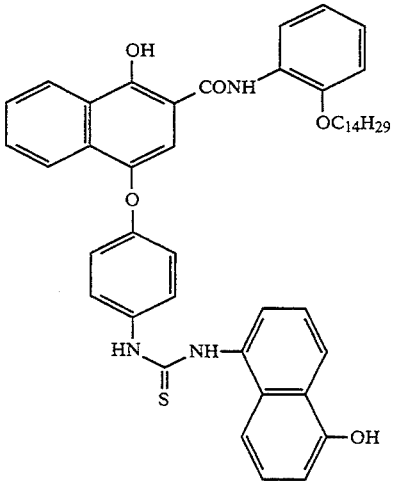
I-6
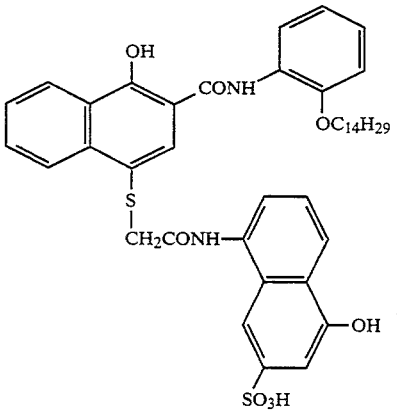

-continued
I-7
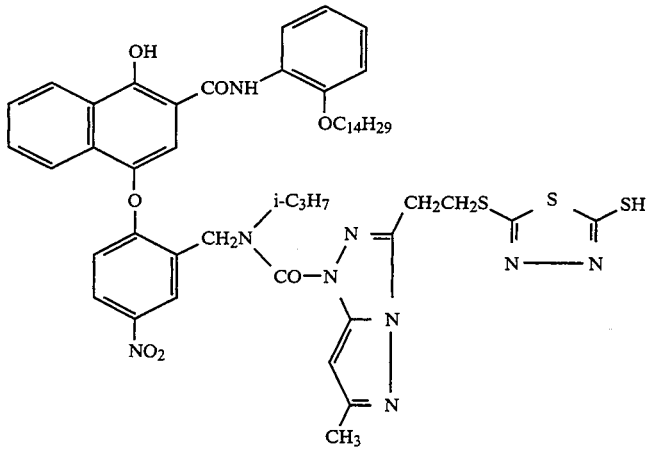
I-8
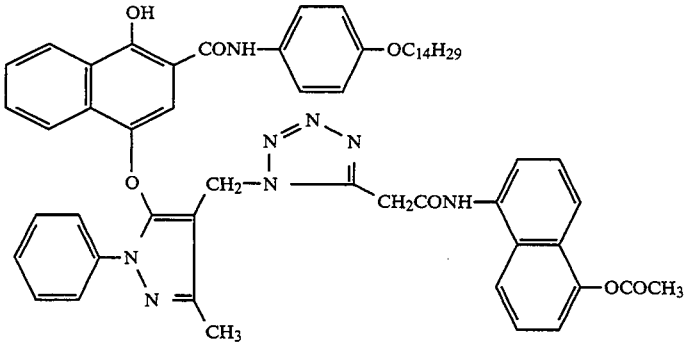
I-9
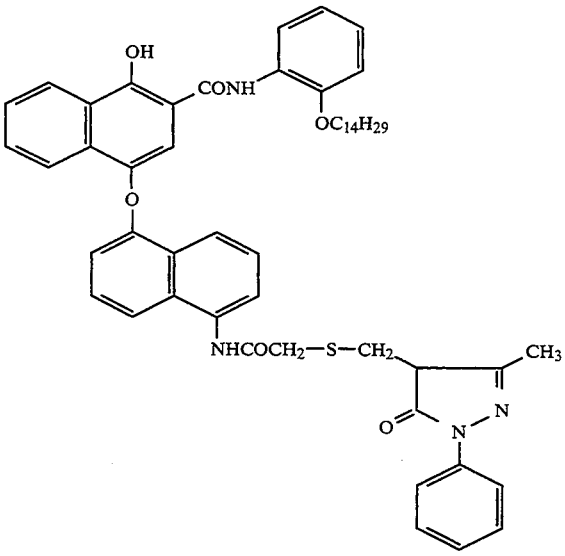

-continued
I-10
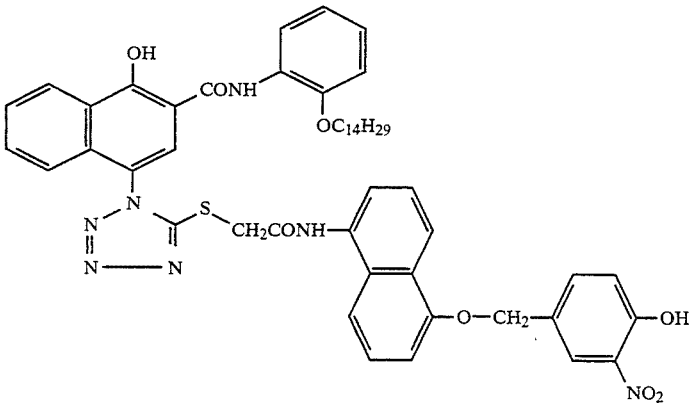
I-11
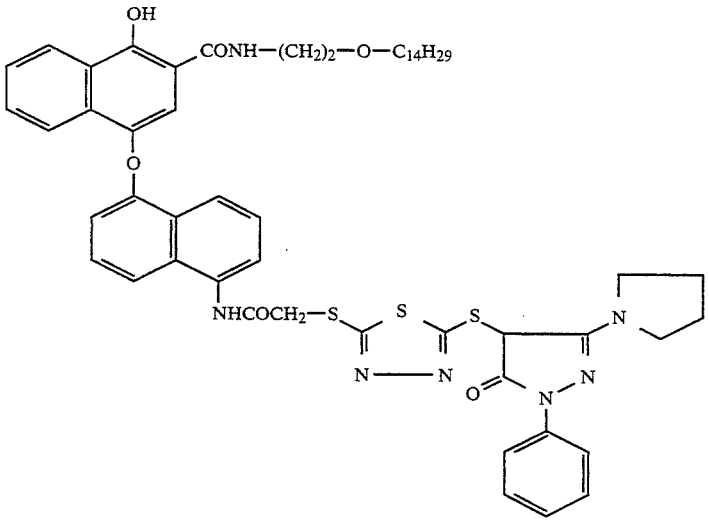
I-12
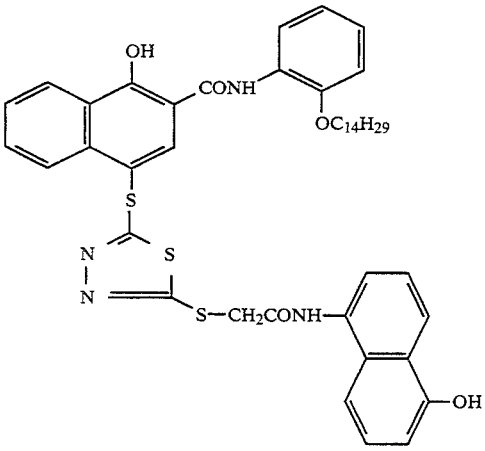

-continued
I-13
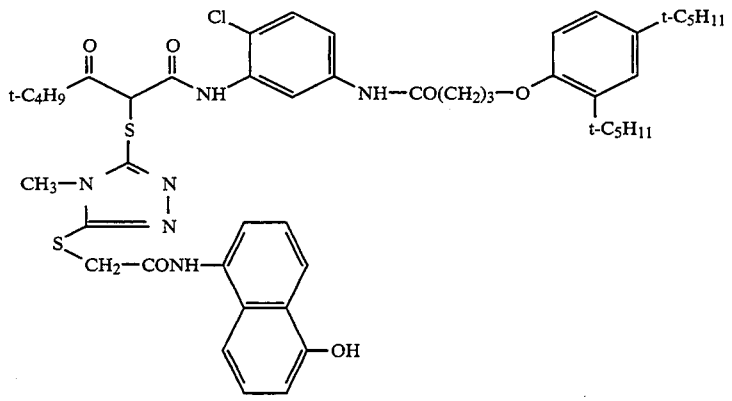
I-14
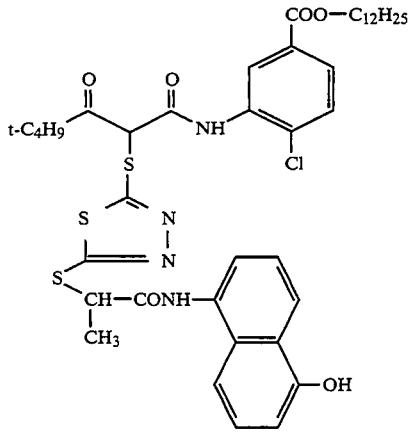
I-15
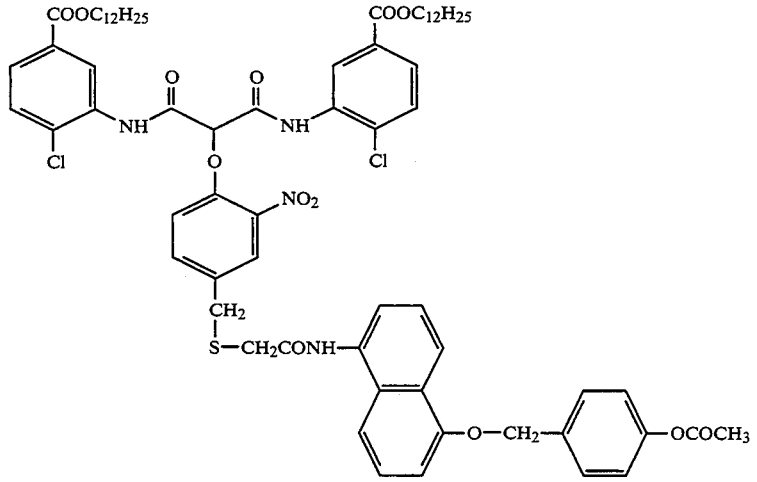

-continued
I-16
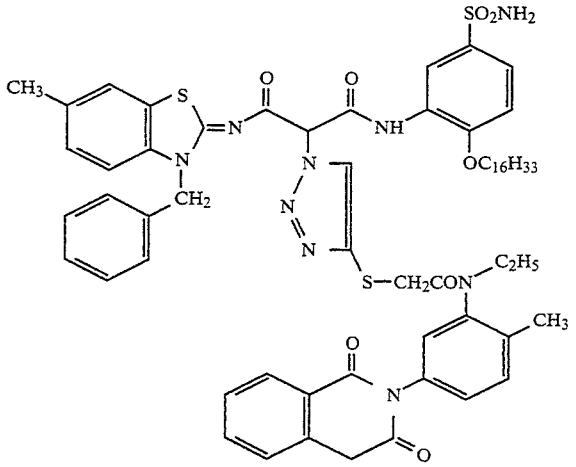
I-17
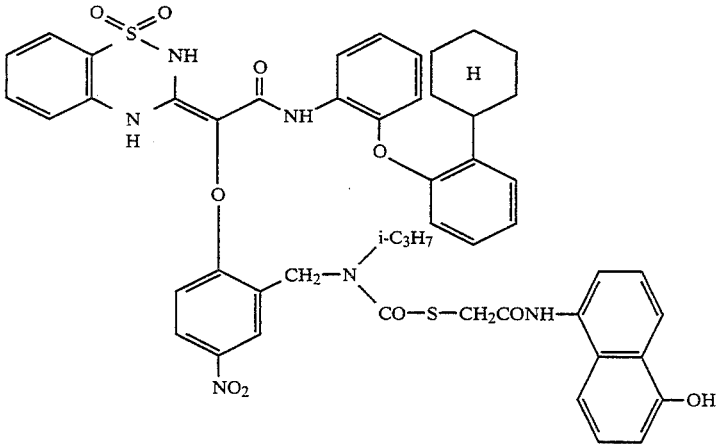
I-18
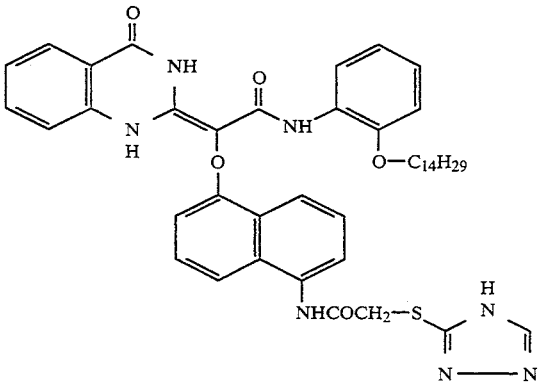

-continued
I-19
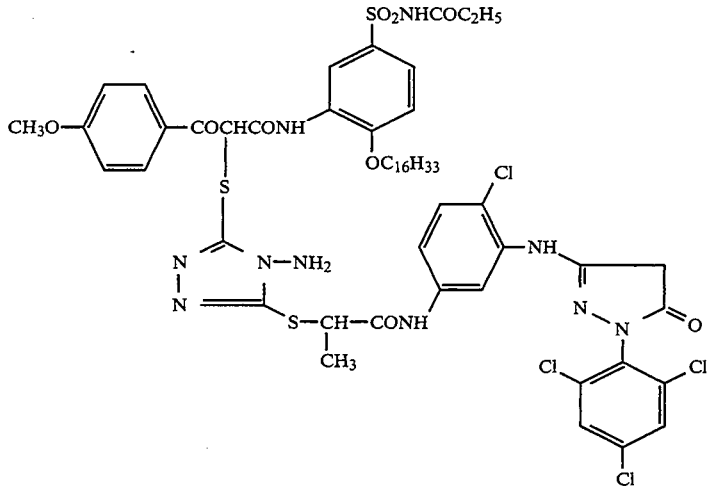
I-20
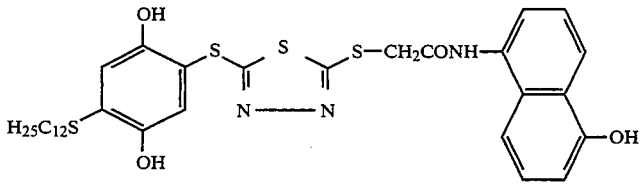
I-21
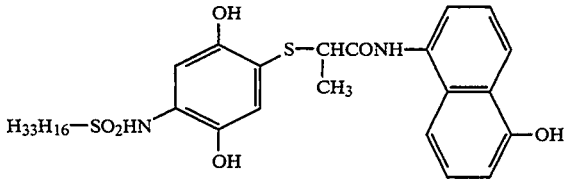
I-22
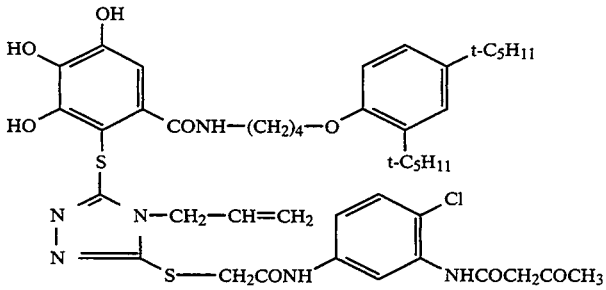
I-23
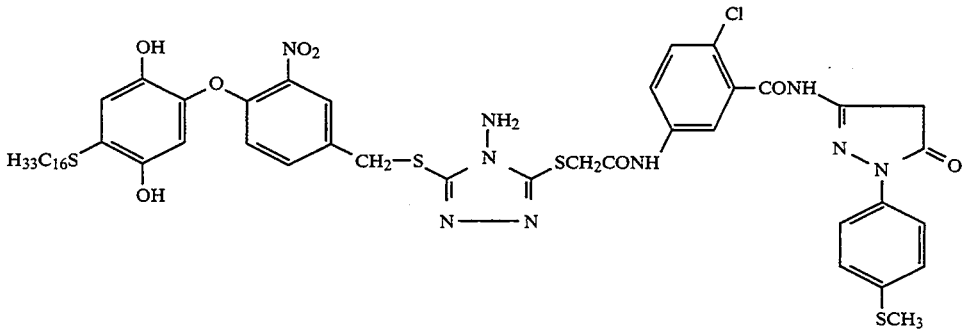

-continued
I-24
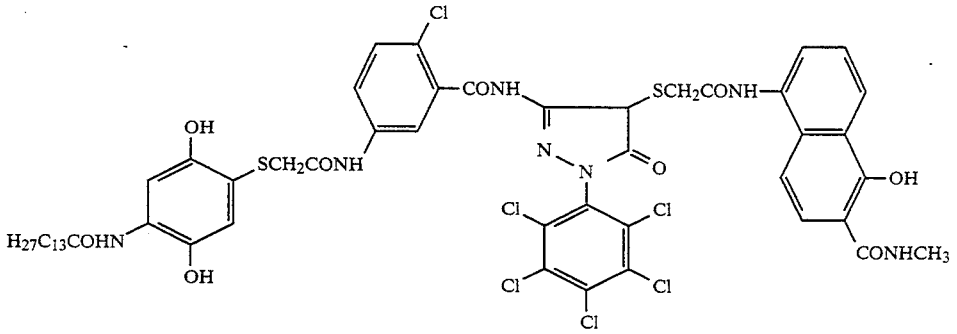
I-25
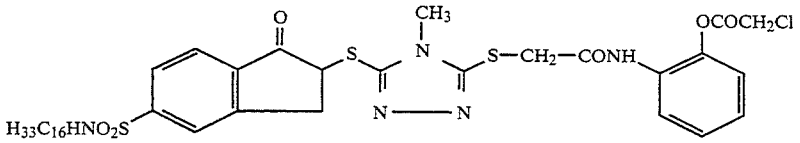
I-26
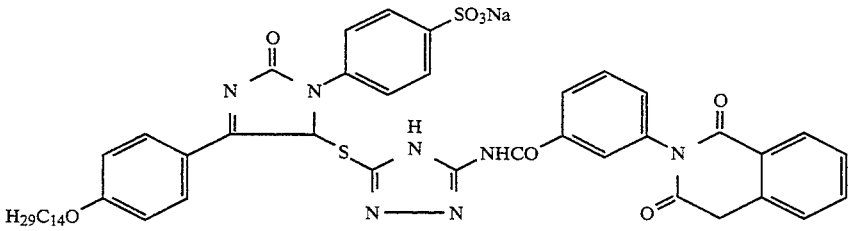
I-27
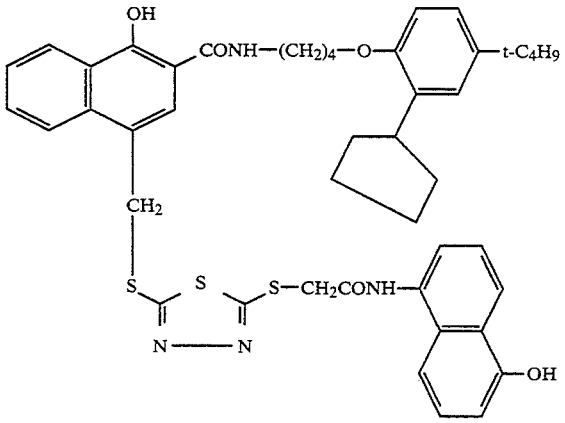
I-28
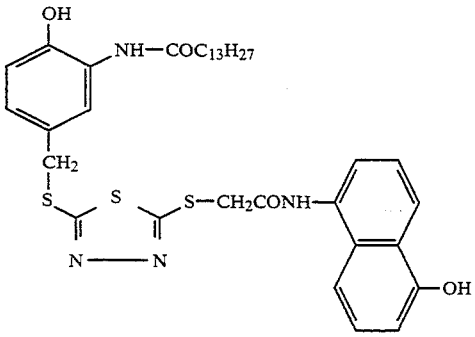

-continued
I-29
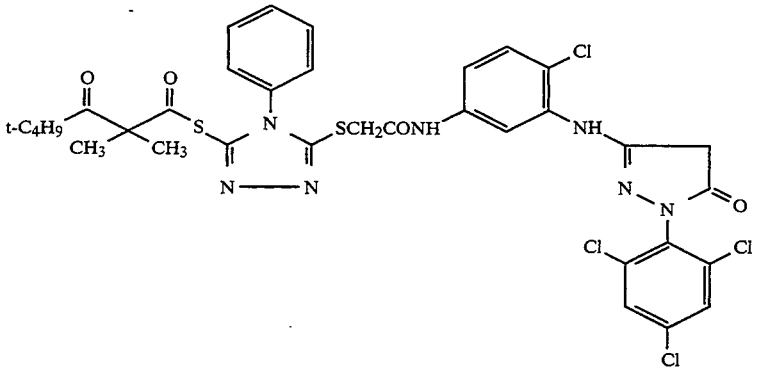
I-30
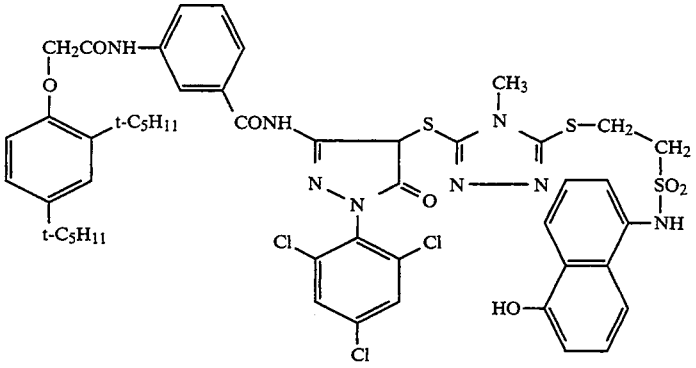
I-31
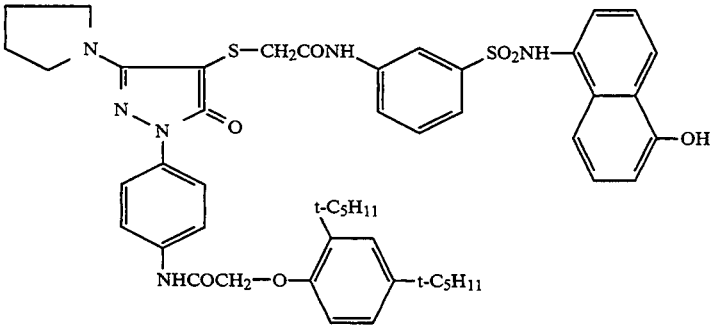
I-32
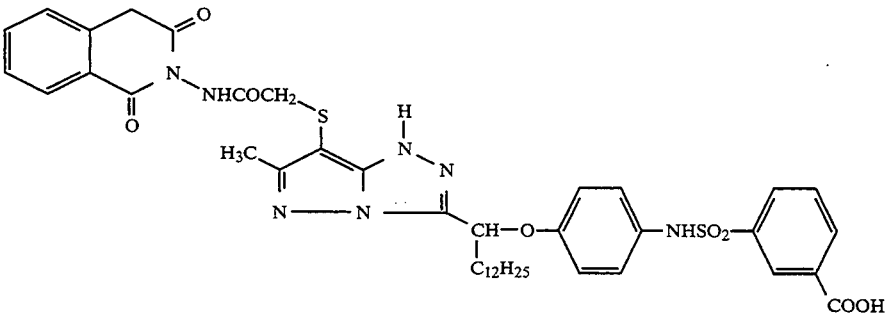

-continued

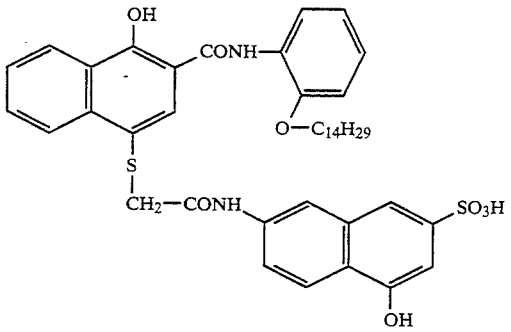

I-33

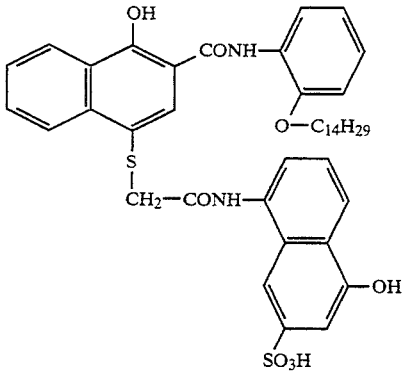

I-34

Preparation of compound I-1

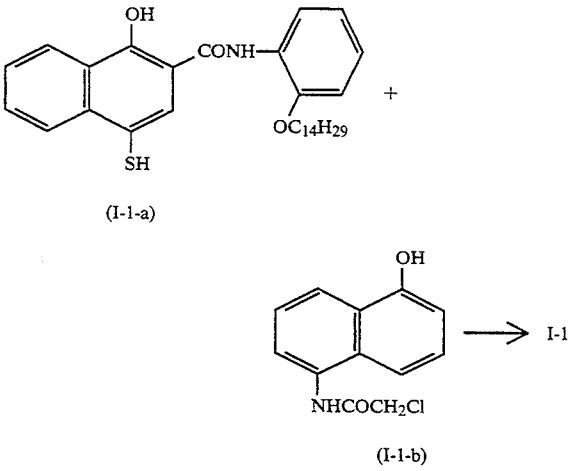

30.6 g of compound I-1-a and 14.1 g of compound I-1-b are stirred into 200 ml of dimethylacetamide. Then 7.8 ml of tetramethylguanidine are added and the mixture is stirred for 1.5 hours at room temperature. The reaction mixture is added to an ice-water/aqu. HCl mixture and the precipitate is filtered under suction, washed with water and methanol and dried. The residue is stirred into 200 ml of hot 1-chlorobutane, filtered after cooling to room temperature, washed with 1-chlorobutene and stirred into 150 ml of a methanol-/ethylacetate 4:1 mixture, filtered and washed.

25.4 g of compound I-1 are obtained, which melt at 158° to 161° C.

The differently sensitised emulsion layers are assigned non-diffusing monomeric or polymeric colour couplers, which can be located in the same layer or in an adjacent layer. Usually the red-sensitive layers are assigned cyan couplers, the green-sensitive layers are assigned magenta couplers and the blue-sensitive layers are assigned yellow couplers.

Colour couplers to produce the cyan section of the coloured image are generally couplers of the phenol or α-naphthol type.

Colour couplers to produce the magenta section of the coloured image are generally couplers of the 5-pyrazolone, indazolone or pyrazoloazole type.

Colour couplers to produce the yellow section of the coloured image are generally couplers with an open-chain keto-methylene grouping, especially couplers of the α-acylacetamide type. Suitable examples of these are α-benzoylacetanilide coupler and α-pivaloylacetanilide coupler.

The colour couplers can be 4-equivalent couplers, but can also be 2-equivalent couplers. The latter are derived from 4-equivalent couplers in that they contain a substituent at the coupling site which is released during coupling. Included among 2-equivalent couplers are those which are colourless, and also those which have an inherent intense colour which vanishes during colour coupling or which is replaced by the colour of the image dye which is produced (masking coupler), and white couplers which produce essentially colourless products with colour developer oxidation products. Included among 2-equivalent couplers are also those couplers which contain a group at the coupling site which can be released, which is released during reaction with colour developer oxidation products and thereby, either directly or after one or more further groups have been released from the primary group which was released (e.g. DE-A-27 03 145, DE-A-28 55 697, DE-A-31 05 026, DE-A-33 19 428), display a specifically desired photographic effectiveness, e.g. as a development inhibitor (DIR coupler).

DIR couplers which release development inhibitors of the azole type, e.g. triazoles and benzotriazoles, are described in DE-A-2 414 006, 2 610 546, 2 659 417, 2 754 281, 2 726 180, 3 626 219, 3 630 564, 3 636 824, 3 644 416 and 2 842 063. Further advantages for colour reproduction, i.e. colour separation and colour purity, and for reproduction of detail, i.e. sharpness and granularity, are produced with those DIR couplers which e.g. do not release the development inhibitor immediately as a result of coupling with an oxidised colour developer, but only after a further secondary reaction, which is achieved, for example, using a time regulating group. Examples of this are described in DE-A-28 55 697, 32 99 671, 38 18 231, 35 18 797, in EP-A-157 146 and 204 175, in U.S. Pat. Nos. 4,146,396 and 4,438,393 and in GB-A-2 072 363.

DIR couplers which release a development inhibitor which is decomposed in the developer bath to give essentially photographically inactive products, are described, for example, in DE-A-32 09 486 and in EP-A-167 168 and 219 713. Use of this measure achieves trouble-free development and processing constancy.

The use of DIR couplers, in particular those which release a development inhibitor which can readily diffuse, can produce, for example, improvements in differentiated colour reproduction, by means of appropriate measures during optical sensitisation, as is described, for example, in EP-A-115 304, 167 173, GB-A-2 165 058, DE-A-3 700 419 and U.S. Pat. No. 4,707,436.

DIR couplers can be added to very different types of layers in multi-layered photographic materials, e.g. even to light-insensitive or intermediate layers. Preferably, however, they are added to the light-sensitive silver halide emulsion layers, wherein the characteristic properties of silver halide emulsion, e.g. their iodide content, the structure of the silver halide grains or their grain size distribution have an effect on the photographic properties produced. The effect of the released inhibitors can be restricted, for example, by the incorporation of an inhibitor trapping layer in accordance with DE-A-24 31 223. For reasons of reactivity or stability, it may be advantageous to use a DIR coupler which, in any layer into which it is introduced, forms a colour during coupling which is different from the colour to be produced in that layer.

It may be advantageous, to modify the action of a photographically active group which is released from a coupler by the occurrence of an intermolecular reaction between this group and another group, after its release, in accordance with DE-A-3 506 805.

Since, in the case of compounds of the formula I and DIR couplers, it is mainly the effectiveness of the group which is released during coupling which is of importance, rather than the colour-forming properties of these couplers, suitable substances are those from which essentially colourless products are produced during coupling (DE-A-1 547 640).

Furthermore, the material may contain different compounds from couplers, which release, for example, a development inhibitor, a development accelerator, a bleach accelerator, a developer, a silver halide solvent, a fogging agent or an anti-fogging agent, for example so-called DIR hydroquinones and other compounds, such as are described, for example, in U.S. Pat. Nos. 4,636,546, 4,345,024, 4,684,604 and in DE-A-3 145 640, 2 515 213, 2 447 079 and in EP-A-198 438. These compounds fulfil the same function as DIR, DAR or FAR couplers, except that they form no coupling products.

High-molecular colour couplers are described, for example, in DE-C-1 297 417, DE-A-24, 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. High-molecular colour couplers are generally prepared by polymerising ethylenically unsaturated monomeric colour couplers. They can also be obtained, however, by polyaddition or polycondensation.

Incorporation of couplers or other compounds in silver halide emulsion layers can take place in such a way that initially a solution, dispersion or emulsion of the compound concerned is prepared and then added to the pouring solution for the layer concerned. Selection of a suitable solvent or dispersant depends on the solubility of the particular compound.

Methods for introducing compounds which are essentially insoluble in water by means of a milling procedure are described, for example, in DE-A-2 609 741 and DE-A-2 609 742.

Hydrophobic compounds can also be introduced into the pouring solution by using high-boiling solvents, so-called oil-formers. Appropriate methods are described, for example, in U.S. Pat. Nos. 2,322,027, 2,801,170, 2,801,171 and EP-A-0 043 037.

Instead of high-boiling solvents, oligomers or polymers, so-called polymeric oil-formers, can be used.

The compounds may also be introduced into the pouring solution in the form of loaded latices. Reference is made, for instance, to DE-A-2 541 230, DE-A-2 541 274, DE-A-2 835 856, EP-A-0 014 921, EP-A-0 069 671, EP-A-0 130 115, U.S. Pat. No. 4,291,113.

Diffusion-resistant inclusion of anionic water-soluble compounds (e.g. of dyes) can also take place using cationic polymers, so-called mordant polymers.

Suitable oil-formers are, for instance, alkyl phthalates, phosphonates, phosphates, citrates, benzoates, amides, carboxylates, trimesates, alcohols, phenols, aniline derivatives and hydrocarbons.

Examples of suitable oil-formers are dibutyl phthalate, dicycohexyl phthalate, di-2-ethylhexyl phthalate, decyl phthalate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexyl benzoate, dodecyl benzoate, 2-ethylhexyl p-hydroxybenzoate, diethyldodecanamide, N-tetradecyl pyrrolidone, isostearyl alcohol, 2,4-di-tert.amylphenol, dioctyl acelate, glycerine tributyrate, isostearyl lactate, trioctyl citrate, N,N-dibutyl-2-butoxy-5-tert.octyl aniline, paraffin, dodecylbenzene and diisopropylnaphthalene.

Each of the different sensitised, light-sensitive layers can consist of a single layer or comprise two or more silver halide emulsion part layers (DE-C-1 121 470). Red-sensitive silver halide emulsion layers are frequently located nearer to the layer support than green-sensitive silver halide emulsion layers and these in turn are closer than blue-sensitive layers, wherein in general a non-light-sensitive yellow filter layer is located between green-sensitive layers and blue-sensitive layers.

In the case of a suitably low sensitivity in the green or red-sensitive layers, other layer arrangements can be selected without using the yellow filter layer, in which the sequence on the support, is then e.g. the blue-sensitive followed by the red-sensitive and finally the green sensitive layer.

The non-light-sensitive intermediate layers which are generally arranged between layers with different spectral sensitivity can contain agents which prevent diffusion of developer oxidation products from one light-sensitive layer into another light-sensitive layer with a different spectral sensitisation.

Suitable agents, which are also called scavengers or EOP traps, are described in Research Disclosure 17.643/1978, chapter VII, 17.842/1979, pages 94–97 and 18.716/1979, page 650 and also in EP-A-69 070, 98 072, 124 877, 125 522 and in U.S. Pat. No. 463,226.

If there are several part layers with the same spectral sensitisation present, then these can be differentiated with respect to their composition, in particular with respect to the type and amount of silver halide grains. In general, the part layers with higher sensitivity are located further from the support than part layers with lower sensitivity. Part layers with the same spectral sensitisation can be adjacent to each other or be separated by layers with a different spectral sensitisation. Thus, for example, all the high-sensitivity and all the low-sensitivity layers respectively may be combined into one set of layers (DE-A 1 958 709, DE-A 2 530 645, DE-A 2 622 922).

Furthermore, the photographic material can contain UV-absorbing compounds, optical brightening agents, spacers, filter dyes, formalin traps, light protecting agents, antioxidants, $D_{min}$ dyes, additives to improve the stability of dyes, couplers and whiteness or to reduce fogging of dyes, and other compounds.

The layers in the photographic material can be hardened using conventional hardeners. Suitable hardeners are e.g. formaldehyde, glutaraldehyde and similar aldehyde compounds, diacetyl, cyclopentadione and similar ketone compounds, bis-(2-chloroethyl-urea), 2-hydroxy-4,6-dichloro-1,3,5-triazine and other compounds which contain reactive halogen (U.S. Pat. Nos. 3,288,775, 2,732,303, GB-A-974 723 and GB-A 1 167 207), divinylsulphone compounds, 5-acetyl-l,3-diacryloylhexahydro-1,3,5-triazine and other compounds which contain a reactive olefin bond (U.S. Pat. Nos. 3,635,718, 3,232,763 and GB-A-994 869); N-hydroxymethyl phthalimide and other N-methylol compounds (U.S. Pat. Nos. 2,732,316 and 2,586,168); isocyanates (U.S. Pat. No. 3,103,437); aziridine compounds (U.S. Pat. Nos. 3,017,280 and 2,983,611); acid derivatives (U.S. Pat. Nos. 2,725,294 and 2,725,295); compounds of the carbodiimide type (U.S. Pat. No. 3,100,704), carbamoylpyridinium salts (DE-A 2 225 230 and DE-A 2 439 551); carbamoyloxypyridinium compounds (DE-A-2 408 814); compounds with a phosphorus-halogen bond (JP-A-113 929/83); N-carbonyloximide compounds (JP-A-43353/81); N-sulphonyloximido compounds (U.S. Pat. No. 4,111,926), dihydroquinoline compounds (U.S. Pat. No. 4,013,468), 2-sulphonyloxypyridinium salts (JP-A-110 762/81), formadinium salts (EP-A 0 162 308), compounds with two or more N-acyloximino groups (U.S. Pat. No. 4,052,373), epoxy compounds (U.S. Pat. No. 3,091,537), compounds of the isoxazole type (U.S. Pat. Nos. 3,321,313 and 3,543,292); halocarboxyaldehydes, such as mucochloric acid; dioxan derivatives such as dihydroxydioxan and dichlorodioxan; and inorganic hardeners such as chrome alum and zirconium sulphate.

Hardening can be produced in a known way by adding the hardener to the pouring solution for the layer to be hardened, or by coating the layer to be hardened with a layer which contains a diffusable hardener.

Among the types listed are slow-acting and fast-acting hardeners as well as instant hardeners, which are especially advantageous. By instant hardeners are meant compounds which cross-link suitable binders in such a way that directly after pouring out, at the latest after 24 hours, preferably at the latest after 8 hours, hardening has proceeded so far that no further change in the sensitometry and swelling of the set of layers takes place as a result of the cross-linking reaction. By swelling is to be understood the difference between the thickness of the wet layer and that of the dry layer during aqueous processing of the film (Photogr. Sci. Eng. 8 (1964), 275; Photogr. Sci. Eng. (1972), 449).

These hardeners which react very rapidly with gelatine are e.g. carbamoylpyridinium salts which are capable of reacting with free carboxyl groups in the gelatine so that the latter react with free amino groups in the gelatine to form peptide bonds and cross-link the gelatine.

Colour photographic negative materials are usually processed by developing, bleaching, fixing and washing or by developing, bleaching, fixing and stabilising without subsequent washing, wherein bleaching and fixing may be combined in one processing step. As colour developer compounds, any developer compounds can be used which have the ability, in the form of their oxidation product, to react with colour couplers to produce azomethine or indophenol dyes. Suitable colour developer compounds are aromatic compounds of the p-phenylenediamine type which contain at least one primary amino group, for example N,N-dialkyl-p-phenylenediamines such as N,N-diethyl-p-phenylenediamine, 1-(N-ethyl-N-methanesulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other colour developers which can be utilised are described in, for instance, J. Amer. Chem. Soc. 73, 3106 (1951) and G. Haist, Modern Photographic Processing, 1979, John Wiley and Sons, New York, page 545 et seq.

An acid stop bath or washing can follow colour development.

Usually, the material is bleached and fixed immediately after colour development. Bleaches which can be used are e.g. Fe(III) salts and Fe(III) complex salts such as ferricyanides, dichromates and water-soluble cobalt complexes. Iron-(III) complexes of aminopolycarboxylic acids, in particular of e.g. ethylenediaminetetraacetic acid, propylenediaminetetraacetic acid, diethylenetriaminepentaacetic acid, nitrilotriacetic acid, iminodiacetic acid, N-hydroxyethyl-ethylenediaminetriacetic acid or alklyliminodicarboxylic acids and of corresponding phosphonic acids are particularly preferred. Persulphates are also suitable as bleaches.

Generally, washing follows the bleaching-fixing bath or fixing bath, this being designed as a countercurrent washing unit or consisting of several tanks each with their own water supply.

Favourable results can be obtained by using a subsequent final bath which contains no, or only a little, formaldehyde.

The washing procedure can be completely replaced, however, by a stabilising bath which is generally fed in a countercurent. This stabilising bath also takes on the function of a final bath when formaldehyde is added.

EXAMPLE 1

A colour photographic recording material for developing colour negatives was prepared (layer structure 1A), by applying, to a transparent layer support made of cellulose triacetate, the following layers in the stated sequence. The data referring to amounts is always with respect to 1 $m^2$. For applying the silver halide, the corresponding amounts of $AgNO_3$ were stabilised with 0.5 g of 4-hydroxy-6-methyl-1,3,3a,7-tetraazaindene.

1st layer (antihalo layer)

| | |
|---|---|
| 0.3 g | black colloidal silver |
| 1.2 g | gelatine |
| 0.4 g | UV absorber UV 1 |
| 0.02 g | tricresyl phosphate (TCP) |

2nd layer (micrate intermediate layer)

| | |
|---|---|
| 0.25 g | $AgNO_3$ in a micrate Ag(Br, I) emulsion, average grain diameter 0.07 μm, 0.5 mol. % of iodide |
| 1.0 g | gelatine |

3rd layer (low-red-sensitive layer)

| | |
|---|---|
| 2.7 g | $AgNO_3$ in a spectrally red-sensitised Ag(Br, I) emulsion with 4 mol. % of iodide, average grain diameter 0.5 μm |
| 2.0 g | gelatine |
| 0.88 g | colourless coupler C1 |
| 0.02 g | DIR coupler D1 |
| 0.05 g | coloured coupler RC-1 |
| 0.07 g | coloured coupler YC-1 |
| 0.75 g | TCP |

4th layer (high-red-sensitive layer)

| | |
|---|---|
| 2.2 g | $AgNO_3$ in spectrally red-sensitised Ag(Br, I) emulsion, 12 mol. % iodide, average grain diameter 1.0 μm |
| 1.8 g | gelatine |
| 0.19 g | colourless coupler C2 |
| 0.17 g | TCP |

5th layer (intermediate layer)

| | |
|---|---|
| 0.4 g | gelatine |
| 0.15 g | white coupler W-1 |
| 0.06 g | the aluminium salt of aurine-tricarboxylic acid |

6th layer (low-green-sensitive layer)

| | |
|---|---|
| 1.9 g | $AgNO_3$ in a spectrally green-sensitised Ag(Br, I) emulsion, 4 mol. % iodide, average grain diameter 0.35 μm |
| 1.8 g | gelatine |
| 0.54 g | colourless coupler M-1 |
| 0.24 g | DIR coupler D-1 |
| 0.065 g | coloured coupler YM-1 |
| 0.6 g | TCP |

-continued

7th layer (high-green-sensitive layer)

| | |
|---|---|
| 1.25 g | $AgNO_3$ in a spectrally green-sensitised Ag(Br, I) emulsion, 9 mol. % iodide, average grain diameter 0.8 μm |
| 1.1 g | gelatine |
| 0.195 g | colourless coupler M-2 |
| 0.05 g | coloured coupler YM-2 |
| 0.245 g | TCP |

8th layer (yellow filter layer)

| | |
|---|---|
| 0.09 g | yellow colloidal silver |
| 0.25 g | gelatine |
| 0.08 g | scavenger SC1 |
| 0.40 g | formaldehyde trap FF-1 |
| 0.08 g | TCP |

9th layer (low-blue-sensitive layer)

| | |
|---|---|
| 0.9 g | $AgNO_3$ in a spectrally blue-sensitised Ag(Br, I) emulsion, 6 mol. % iodide, average grain diameter 0.6 μm |
| 2.2 g | gelatine |
| 1.1 g | colourless coupler Y-1 |
| 0.037 g | DIR coupler D-1 |
| 1.14 g | TCP |

10th layer (high-blue-sensitive layer)

| | |
|---|---|
| 0.6 g | $AgNO_3$ in a spectrally blue-sensitised Ag(Br, I) emulsion, 10 mol. % iodide, average grain diameter 1.2 μm |
| 0.6 g | gelatine |
| 0.2 g | colourless coupler D-1 |
| 0.003 g | DIR coupler D-1 |
| 0.22 g | TCP |

11th layer (micrate layer)

| | |
|---|---|
| 0.06 g | $AgNO_3$ in a micrate-Ag(Br, I) emulsion, average grain diameter 0.06 μm, 0.5 mol. % iodide |
| 1 g | gelatine |
| 0.3 g | UV absorber UV-2 |
| 0.3 g | TCP |

12th layer (protective and hardening layer)

| | |
|---|---|
| 0.25 g | gelatine |
| 0.75 g | hardening agent of the formula |

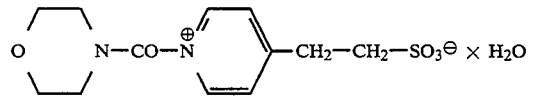

So that the overall layered structure had a swelling factor of ≦3.5 after hardening.

The substances used in example 1 were:

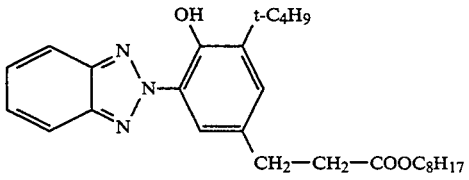

UV-1

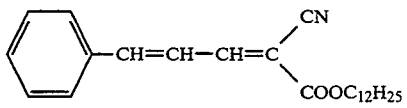

UV-2

-continued
C 1
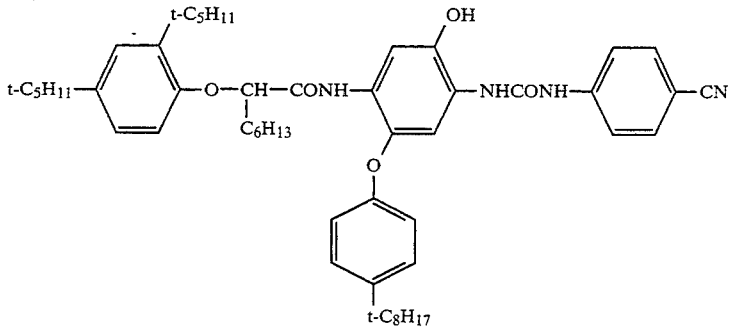
C 2
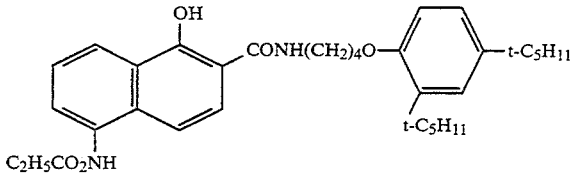
RC-1
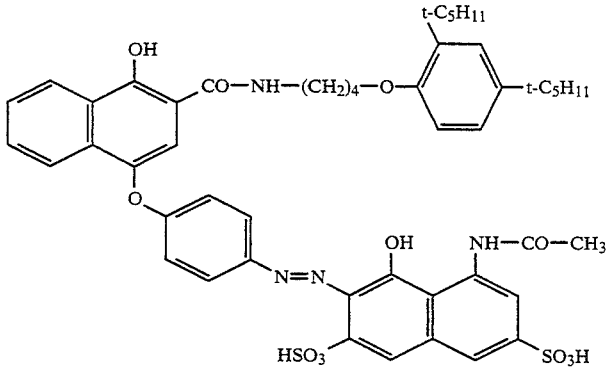
M-1
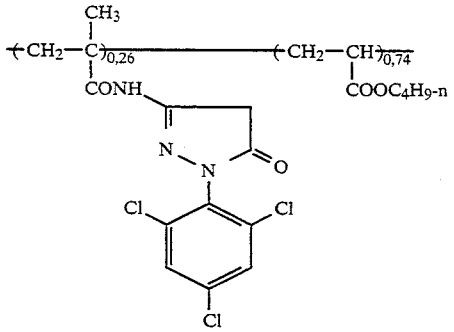
M2
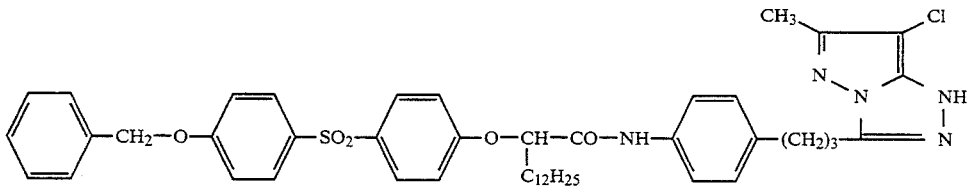

-continued
YM-1
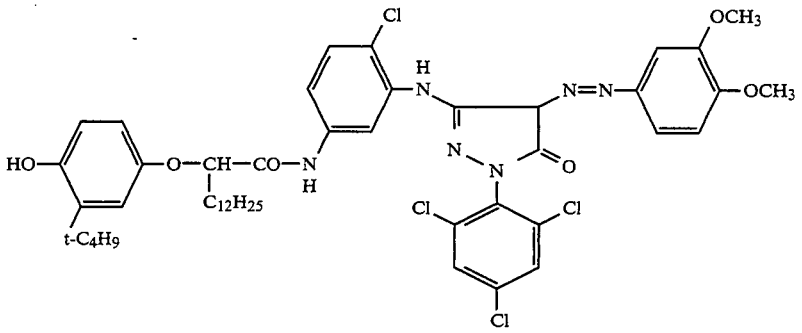
Y 1
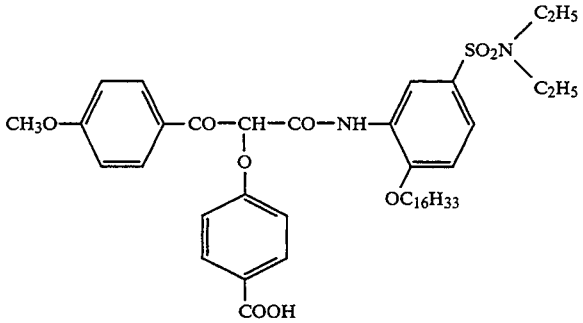
D-1
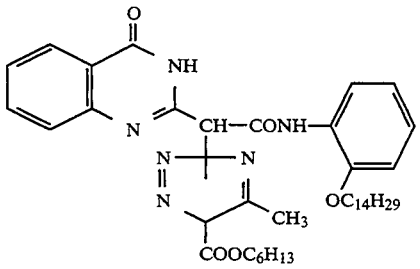
YC-1
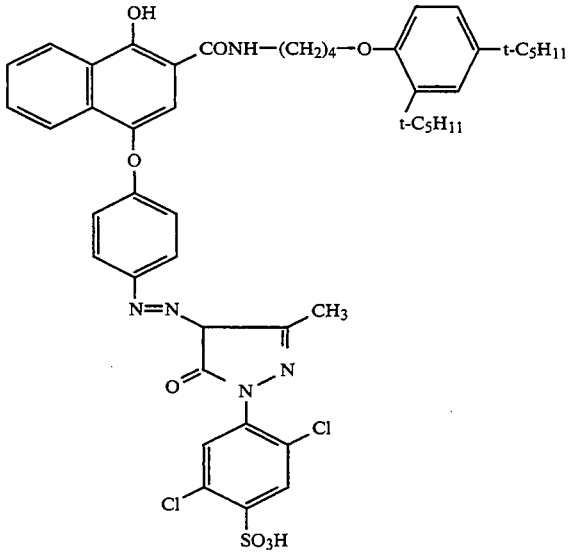

-continued
YM-2
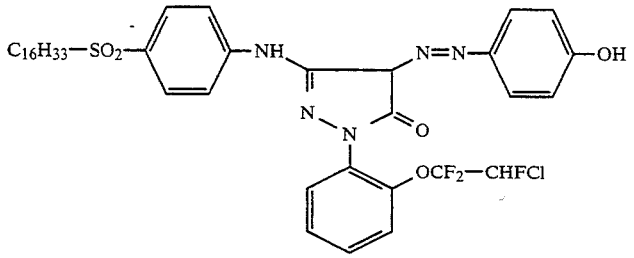
SC-1
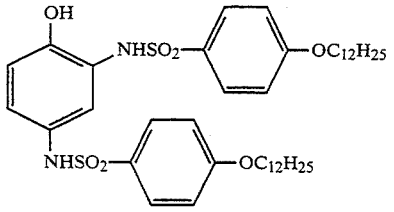
FF-1
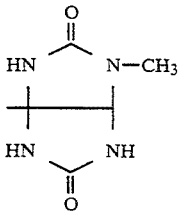
W-1
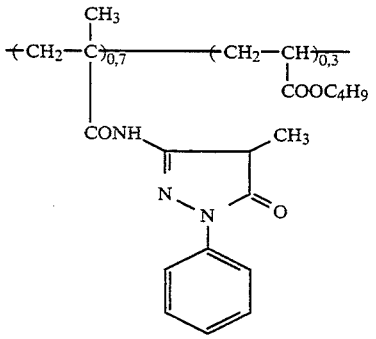
V-1
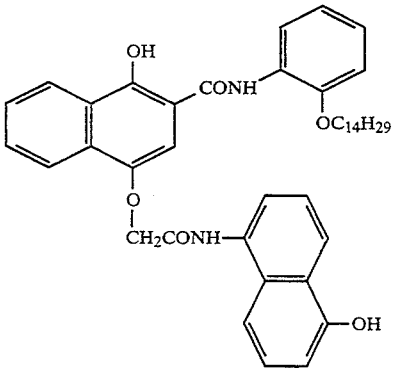

-continued

V-2

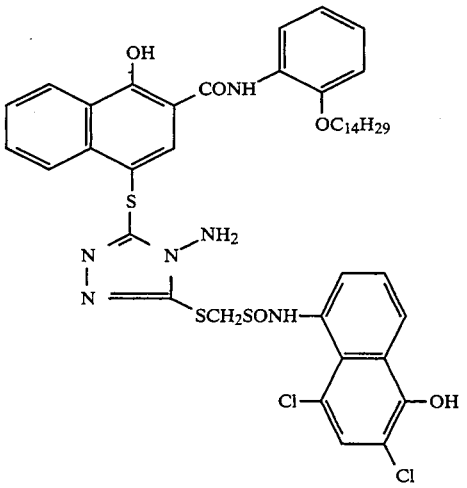

V-3

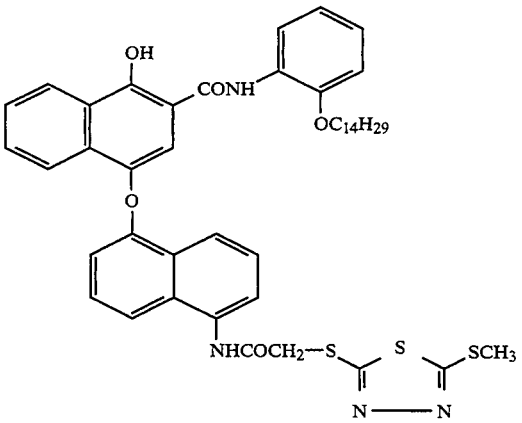

V-4

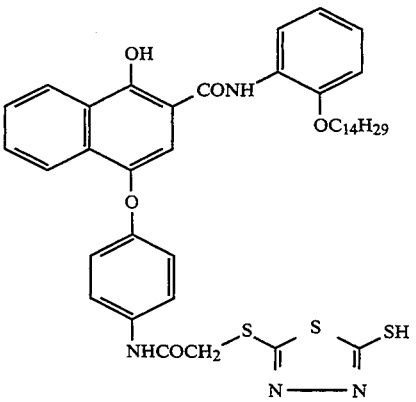

In layer structures 1B–1K, a compound according to the invention or a comparison compound was also added to the 10th layer, in an amount of 4.25 μmol/m². The compounds and the results are given in Table 1.

After exposure of a grey wedge, development was performed in accordance with "The British Journal of Photography", 1974, pages 597 and 598.

TABLE 1

| Material | Compound | Relative sensitivity Yellow | Comment |
|---|---|---|---|
| 1A | — | 100 | Comparison |
| 1B | V1 | 99 | Comparison |
| 1C | V2 | 100 | Comparison |

TABLE 1-continued

| Material | Compound | Relative sensitivity Yellow | Comment |
|---|---|---|---|
| 1D | V3 | 99 | Comparison |
| 1E | V4 | 101 | Comparison |
| 1F | I-1 | 115 | Invention |
| 1G | I-5 | 113 | Invention |
| 1H | I-12 | 109 | Invention |
| 1I | I-19 | 110 | Invention |
| 1K | I-20 | 107 | Invention |

It can be seen that there is an increase in sensitivity when using the compounds according to the invention.

EXAMPLE 2

In the case of materials 2B to 2G, a compound according to the invention or a comparison compound are added to the 4th, 7th and 10th layers respectively of layer structure 2, in amounts of 4.25 $\mu mol/m^2$ per layer. The compounds and the results are given in Table 2. Some of the material is stored for 2 weeks at 60° C. and 35% relative humidity, another portion of the material is stored in a normal atmosphere (23° C., 60% rel. hum.). All the materials are exposed and processed as described in example 1. The increase in fogging of material stored in the warm as compared with material stored in a normal atmosphere is taken as a measure of the instability.

TABLE 2

| Material | Coupler | Increase in fogging after storage at 23° C., 60% r.h. ye | ma | cy | Comment |
|---|---|---|---|---|---|
| 2A = 1A | — | 8 | 1 | 3 | Comparison |
| 2B | V-5 | 15 | 10 | 7 | Comparison |
| 2C | V-6 | 10 | 4 | 6 | Comparison |
| 2D | V-7 | 31 | 14 | 10 | Comparison |
| 2E | I-1 | 9 | 1 | 3 | Invention |
| 2F | I-8 | 8 | 2 | 4 | Invention |
| 2G | I-17 | 7 | 2 | 3 | Invention |

ye = yellow, ma = magenta, cy = cyan

V-5

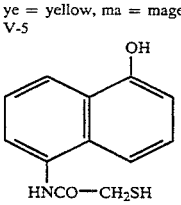

V-6

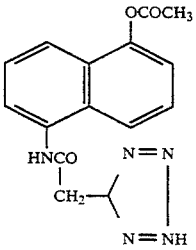

V-6

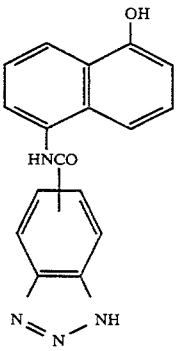

It can be seen that, with the comparison compounds, there is a large increase in fogging, whereas with the compounds according to the invention, the storage behaviour is comparable to that of reference material 2A.

EXAMPLE 3

A material was prepared whose 1st to 8th and 11th layers corresponded to the material in example 1.

| Layer 9 (1st blue-sensitive layer, low sensitivity) blue-sensitised silver bromide iodide emulsion (6 mol. % iodide; average grain diameter 0.60 μm) made from | |
|---|---|
| 0.75 g | $AgNO_3$, with |
| 2.2 g | gelatine |
| 1.1 g | yellow coupler Y-2 |
| 0.034 g | DIR coupler D-1 |
| 1.1 g | TCP |
| **Layer 10 (2nd blue-sensitive layer, high-sensitivity), blue-sensitised silver bromide iodide emulsion (10 mol. % iodide, average grain size 1.20 μm), made from** | |
| 0.48 ng | $AgNO_3$, with |
| 0.6 g | gelatine |
| 0.2 g | yellow coupler Y-2 |
| 0.003 g | DIR coupler D-1 |
| 0.22 g | TCP |
| 0.003 g | compound I-6 |

Material with layer structure 1A and material according to example 3 were exposed and processed as described in example 1. The sensitometric results are given in Table 3. In addition, the edge transfer function (ETF) of a grid with 40 line pairs per mm is given in comparison with the input modulation (=100), as a sharpness parameter.

TABLE 3

| Material | Comment | Rel. sensitivity ye | ma | cy | ETF at 40 lp/mm ma | cy |
|---|---|---|---|---|---|---|
| 1A | Comparison | 100 | 100 | 100 | 70 | 25 |
| 3 | Invention | 101 | 99 | 101 | 75 | 28 |

It can be seen that the material according to the invention has improved sharpness for the same sensitivity with a smaller amount of silver.

We claim:

1. Color photographic silver halide material of the negative type, comprising at least one silver halide emulsion layer contains a compound of the formula $$A\text{-}B\text{-}(T_1)_m\text{-}(COUP\text{-}D\text{-})\text{-}(T_2)_n \quad (I),$$

wherein

A represents a ballast group,

B represents the radical of a compound which reacts to release $(T_1)_m$-(COUP-D)-$(T_2)_n$ during development, $T_1$ and $T_2$ represent time-regulating units which can be released during development, m, n are 0 or 1, COUP represents the radical from a 4-equivalent coupler and D represents a group with an affinity for silver and wherein A-B is the radical from a 2-equivalent coupler which contains the group $(T_1)_m$-(COUP-D)-$(T_2)_n$ bonded at the coupling site, which is linked to B via the group D which has an affinity for silver, wherein COUP-D contains no ballast radicals which make it diffusion-resistant.

2. Color photographic silver halide material according to claim 1, wherein D corresponds to the formulas II*a* to II*e*,

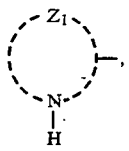

IIa

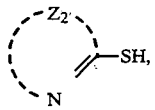

IIb

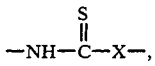

IIc

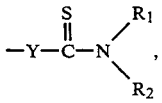

IId

IIe in which $Z_1$ represents the remaining members for completion of a ring which contains at least one other heteroatom, $Z_2$ represents the remaining members for completion of a ring, X represents $—NH_2$, —NHR, $—N(R)_2$, $—NH—NH_2$, —NH—NHR, —SR, —OR Y represents —S—, —NR— or —O—

R represents an aliphatic, aromatic or heterocyclic group and $R_1$, and $R_2$ represent H, an aliphatic, aromatic or heterocyclic group or together represent the remaining members of a 5 or 6-membered ring.

3. The color photographic silver halide material according to claim 1, wherein the color photographic material contains silver bromide iodine emulsions with 5 to 15 mole % of silver iodine.

4. Color photographic silver halide material according to claim 1, wherein the compound of the formula I is used in an amount of 0.0005 to 0.05 mmol/$m^2$ of photographic material.

5. Color photographic silver halide material according to claim 1, which contains at least two red-sensitive cyan-coupling silver halide emulsion layers of different sensitivity, at least two green-sensitive magenta-coupling silver halide emulsion layers of different sensitivity and at least two blue-sensitive yellow-coupling silver halide emulsion layers, wherein at least one high-sensitivity silver halide emulsion layer contains a compound of the formula I.

6. The color photographic silver halide material according to claim 2, wherein $Z_1$ represents the remaining members for completion of a 5 or 6-membered ring and $Z_2$ represents the remaining members for completion of a 5 or 6-membered ring.

7. The color photographic silver halide material according to claim 2, wherein $Z_1$ and $Z_2$ are selected from the group consisting of alkylene groups, arylene groups,

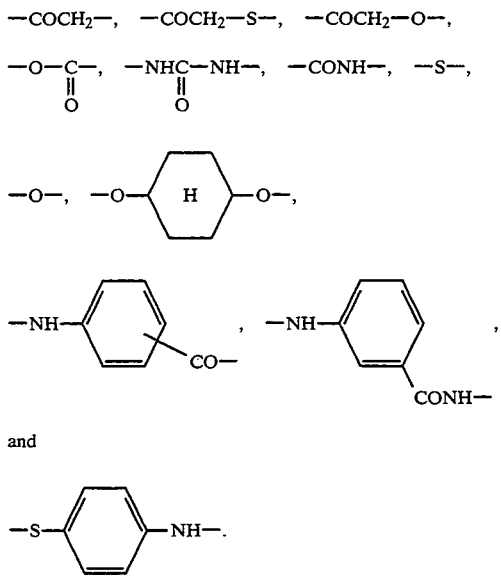

and

8. The color photographic silver halide material according to claim 1, further comprising several different compounds of formula I are used.

* * * * *